United States Patent [19]

Dunn

[11] 4,031,905

[45] June 28, 1977

[54] SMOKING TUBE WITH CHECK VALVE

[76] Inventor: John C. Dunn, 1640 - W. 14th St., Davenport, Iowa 52804

[22] Filed: Sept. 11, 1975

[21] Appl. No.: 612,265

[52] U.S. Cl. ..... 131/173

[51] Int. Cl.[2] ..... A24F 1/30

[58] Field of Search ..... 131/173, 198

[56] References Cited

UNITED STATES PATENTS

| | | | |
|---|---|---|---|
| 1,967,438 | 7/1934 | Hartzes | 131/173 |
| 3,863,646 | 2/1975 | Kahler | 131/173 |
| 3,882,875 | 5/1975 | Frost | 131/173 |

FOREIGN PATENTS OR APPLICATIONS

| | | | |
|---|---|---|---|
| 1,409,942 | 7/1965 | France | 131/173 |

*Primary Examiner*—Stephen C. Pellegrino

*Attorney, Agent, or Firm*—Glenn H. Antrim

[57] ABSTRACT

Quite a large cylindrical tube for a mouthpiece tube and a smaller stem for supporting a small bowl extend upwardly from different portions of a hollow base. The hollow base functions as a reservoir, and the base and the lower portions of the stem and the mouthpiece tube are filled with water. A plastic ball within the mouthpiece tube helps control the draw of the pipe. The plastic ball is the sealing member of the check valve that prevents rapid flow of water from the mouthpiece tube to the stem when inhalation is stopped abruptly. The port of the check valve is a hole that is eccentric within the bottom of the mouthpiece tube. The eccentricity provides a desirable amount of leakage for slowly equalizing the level of water in the mouthpiece tube and the stem.

2 Claims, 3 Drawing Figures

SMOKING TUBE WITH CHECK VALVE

BACKGROUND OF THE INVENTION

This invention relates to smoking pipes and particularly to pipes that utilize change of water level in U-shaped passageways in cooperation with air valves to control ease of inhalation of smoke.

Various arrangements have been used to place a water container in the passageway between the bowl and the mouthpiece of a stem of a smoking pipe. Smoke that is being drawn through the passageway is cleaned and cooled by action of the water or other liquid through which the smoke passes before it is inhaled. Valves have been inserted in the passageway to control the ease of drawing smoke through the stem of the pipe and sometimes for controlling flow of air into the stem for diluting the smoke.

One type of water pipe has a rather large mouthpiece tube with a space to be filled with water. Smoking material is placed in a small bowl at the top of a small upwardly extending stem that communicates with the lower portion of the mouthpiece tube. During inhalation, the water rises slightly, and if the suction from inhalation should suddenly cease in the upper part of the mouthpiece tube, the level of the water will change abruptly to cause the smoking material to be ejected from the bowl.

SUMMARY OF THE INVENTION

Compared with conventional pipes, the present smoking pipe or tube has a relatively small bowl for holding smoking material and has quite a large cylinder or tube, rather than a small stem, through which smoke travels to the smoker. A cylinder is mounted nearly upright and has an upper flared rim of sufficient diameter to encompass the mouth of a smoker. The stem and the tube slant upwardly from a hollow base and communicate with the inside of the base. The mouthpiece tube is much longer than the stem that holds the bowl, and sufficient water is poured into the smoking tube to fill the hollow base and to fill the stem and the mouthpiece tube to a level somewhat below the upper end of the stem.

The movement and concentration of the smoke are controlled by movement of water in the mouthpiece tube in cooperation with inlets or valves in the wall of the mouthpiece tube, the valves being located slightly above the surface of the water. A ball having a specific gravity slightly greater than unity is submerged in water within the bottom portion of the mouthpiece tube. When the valves through the wall of the mouthpiece tube are closed and the smoker draws on the upper end of the mouthpiece tube, the level of the water and the ball within the mouthpiece tube rise slightly while the level of the water in the stem drops.

Should a smoker open the valves that are through the wall of the mouthpiece tube quickly while inhaling, or abruptly cease inhaling from the mouthpiece tube, the level of the water tends to drop in the moutpiece tube and to rise quickly in the stem. This abrupt reversal of flow of water and air tends to eject the smoking material from the small bowl. To prevent ejection of the smoking material, an opening between the bottom of the mouthpiece tube and the hollow base has the proper size and is positioned to function as a port of a check valve in cooperation with the ball that functions as a sealing member. When inhalation ceases, the ball drops over the opening or port to prevent water from rising rapidly in the stem and thereby to prevent ejection of the smoking material. The position of the opening is slightly eccentric with respect to the axis of the tube such that a controlled amount of leakage is permitted downwardly through the opening. The leakage permits slow equalization of the level of water in the stem and the moutpiece tube.

While the smoker continues to inhale, has fingers over the openings, and after the smoking material is mostly burned, its ash is drawn through a small aperture through the bottom of the bowl and down the stem where it is caught in the water in the hollow base or reservoir. As the vacuum is relieved by flow of water through the cleared aperture, the smoker opens the valves or holes within the wall of the mouthpiece tube, and the smoke moves to the upper part of the mouthpiece tube and is inhaled by the smoker.

DESCRIPTION OF THE PREFERRED EMBODIMENT

Figure 1:
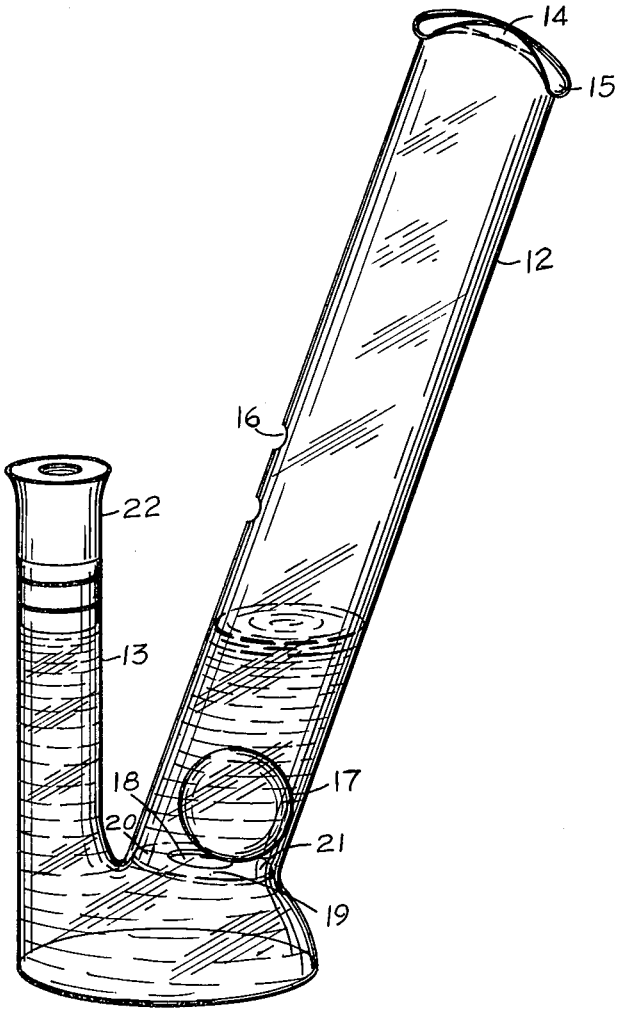
FIG. 1 is a perspective view of the smoking tube of this invention in an upright position.

As shown in FIG. 1, the pipe has a base 11 to be placed on a stand or on a table in front of a smoker. The base 11 is dome-shaped, and it is hollow to function as a reservoir for water. A mouthpiece tube 12 and a stem 13 extend upwardly from the base 11. The stem 13 may be vertical or nearly vertical, and the mouthpiece tube 12 may diverge from a vertical direction sufficiently to facilitate the smoker's placing his face against the upper end of the tube. Since the weight of the water in the tube effects the draw of the pipe, the slant must not be great enough to cause the pipe to draw too easily. For a mouthpiece 14, the upper end of the mouthpiece tube 12 is flared outwardly to form a rim 15 that has a smooth surface for contacting the face of a smoker. Clear polycarbonate resin such as that sold by the General Electric Company under the trademark LEXAN is suitable material for the mouthpiece tube 12 and also for the base 11 and the stem 13. The stem 13 and the base 11 may be molded as a single piece, and the mouthpiece tube 12 may be fabricated from tubular material and spin-welded to the base 11. The diameter of the mouthpiece tube 12 is sufficient to provide a mouthpiece 14 large enough to encompass the mouth of a smoker, and the diameter of the stem 13 needs to be only large enough to hold a small bowl 22 for retaining a small amount of smoking material. The diameter of the mouthpiece tube 12 may be about 5 cm, and its length might be about 32 cm. The length of the stem is only about 14 cm. Preferably, the bowl 22 is a ceramic bowl.

To control the flow of smoke, sufficient water is poured into the smoking tube to fill the hollow base or reservoir 11, to fill most of the stem 13, and to fill less than one-half the mouthpiece 12. One or more openings or air inlets 16 are placed through the wall of the mouthpiece tube 12 somewhat above the level to which the water is to rise. In FIG. 1, two openings 16 are located one above the other through a portion of the wall just below the middle of the mouthpiece tube 12;

the openings function as valves and their diameter and spacing facilitates their being closed easily by the tips of two fingers of a smoker.

Figure 2:
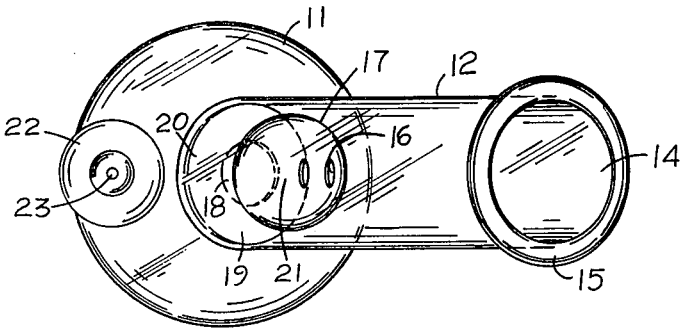
FIG. 2 is a top view of the tube.

In addition to its fixed parts, the smoking tube has a movable plastic ball 17 within the lower end of the mouthpiece tube 12. The diameter of the ball 17 is somewhat less than the inside diameter of the mouthpiece tube 12, and its specific gravity is somewhat greater than unity. The ball 17 controls the upward flow of smoke and is a sealing member of a check valve to prevent rapid downward flow of water. The ball 17 is made of material to which water does not readily adhere, and apparently smoke flows over the surface of the ball within the water more easily than it would directly through the water without the ball being present. A hole 18 for the port of the check valve communicates between the hollow base 11 and the mouthpiece tube 12; the diameter of the port is smaller than the inside diameter of the mouthpiece tube 12 such that a rim 19 extends inwardly from the bottom end of the cylinder for the mouthpiece tube 12. For example, when the diameter of the ball is 3.8 cm, the typical diameter of the hole 18 is 1.6 cm. The position of the port 18 with respect to the axis of the mouthpiece tube 12 is eccentric to provide a desired amount of downward leakage when the check valve is in its closed position. Since the diameter of the ball 17 is only slightly less than the diameter of the mouthpiece tube 12, the ball 17 will not seat fully in the hole 18, and when the column of water in the mouthpiece tube 12 is somewhat higher than the column of water in the stem 13, a small flow of water passes the ball 17 for slowly equalizing the level of water in the mouthpiece tube 12 and the stem 13 without ejecting smoking material. With reference to FIG. 2, the portion 20 of the rim 19 adjacent the stem 13 is about 0.3 cm shorter than the opposite portion 21.

Figure 3:
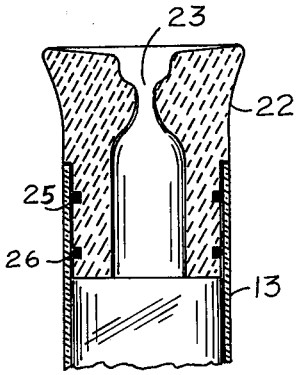
FIG. 3 is a vertical cross-sectional view of the upper end of the stem of the smoking tube and its receptacle or bowl for receiving smoking material.

As shown most clearly in FIG. 3, an assembly for the bowl 22 is pressed into the upper end of the stem 13. Compared with the bowl for receiving smoking material in a conventional pipe, the bowl 22 is relatively small. The upper face of the bowl 22 is shaped like a shallow bowl, and typically it is one to two centimeters in diameter. An aperture 23 with a diameter of about 2.7 mm communicates down through the center of the bottom of the bowl 22 with the inside of the stem 13. The size of the aperture 23 is critical because if it is too large, the smoking material before being burned falls through the aperture 23 into the water within the base 11; and if it is too small, the pipe draws too hard and develops too little smoke. Preferably, the lower portion of the assembly for the bowl 22 has a cylindrical portion 24 with two spaced circumferential grooves for receiving O-rings 25 and 26; the cylindrical portion 24 with the O-rings 25 and 26 being a pressed fit within the upper portion of the stem 13.

In preparation for smoking, the ball 17 is placed inside the mouthpiece tube 12, and water is poured into the tube 12 until it covers the ball 17 and reaches the level substantially below the valve openings 16. A small amount of material to be smoked is placed in the bowl 22 above its aperture 23. The smoker places two fingers over the openings 16, places his mouth within the mouthpiece 14, and ignites the material to be smoked. The smoker inhales continually while the material is being burned and a vacuum is created to raise the level of water within the tube 12 a small amount and to lower the level within the stem 13 a greater amount. Should the smoke become too strong for the smoker, the holes 16 are uncovered to drop the vacuum quickly in the upper portion of the mouthpiece tube 12. The level of water within the mouthpiece tube 12 tends to drop, and the ball 17 drops over the hole 18. The ball 17 functions as a sealing member, and the hole 18 functions as a port of a check valve. The flow of water downwardly through the port 18 is checked to prevent ejection of smoking material from the bowl 22 by sudden reversal of flow of water. Since the port 18 is eccentric, leakage past the ball 17 allows the columns of water in the mouthpiece tube 12 and the stem 13 to equalize in height gradually.

Usually the holes 16 are kept covered until the smoking material is burned and is drawn through the aperture 23 of the bowl 22. As the smoking material passes through the aperture 23, pressure within the upper portion of the stem 13 is decreased suddenly and causes the level of water and the ball 17 in the mouthpiece tube 12 to rise quickly, or bounce, to move the smoke toward and into the upper portion of the tube 12. At this time, the smoker removes his fingers from the holes of valves 16 to allow air to enter the mouthpiece tube 12 and to cause the column of smoke to rise to the smoker.

I claim:

1. A smoking device comprising a hollow base to function as a reservoir for water, a hollow stem extending upwardly from said base, a bowl for holding smoking material, said bowl connected to the upper end of said stem and having a small aperture through the bottom thereof communicating through said stem to the inside of said hollow base, a mouthpiece tube extending upwardly from said hollow base, the cross-section of said mouthpiece tube being substantially greater than that of said stem, a check valve having a valve port and a sealing member, said valve port having an upwardly facing opening communicating between the inside of said mouthpiece tube and the inside of said hollow base, said sealing member being contained within said mouthpiece tube, said sealing member having a specific gravity somewhat greater than unity and being adapted to drop to a position over said opening for substantially restricting flow of water through said port, said mouthpiece tube having a mouthpiece opposite said hollow base, said smoking device to contain a sufficient amount of water to fill said hollow base and the adjacent portions of said stem and said mouthpiece tube to a level above said sealing member, and said sealing member being free to move upwardly above said port in response to inhalation through said mouthpiece to permit water to flow upwardly through said port to raise the level of water in said mouthpiece tube and being free to drop upon cessation of inhalation to prevent rapid reversal of flow of water through said port and upwardly into said stem.

2. A smoking device as claimed in claim 1 wherein said mouthpiece tube is cylindrical, said valve port comprises an opening through the wall of said hollow base, the diameter of said opening being substantially less than the diameter of said tubing and being slightly eccentric to provide a rim of slightly non-uniform width about said opening, and said sealing member being a ball having a diameter slightly less than the internal diameter of said tubing, the eccentricity of said opening providing controlled downward leakage through said port upon cessation of inhalation.

* * * * *